US007605808B2

(12) United States Patent
Lee et al.

(10) Patent No.: US 7,605,808 B2
(45) Date of Patent: Oct. 20, 2009

(54) ENERGY RECOVERY APPARATUS AND METHOD FOR PLASMA DISPLAY PANEL

(75) Inventors: Nam Kyu Lee, Changwon-si (KR); Bong Gyun Kim, Busan (KR); Bong Hwan Kwon, Pohang-si (KR); Jang Hwan Cho, Gumi-si (KR)

(73) Assignee: LG Electronics Inc., Seoul (KR)

( * ) Notice: Subject to any disclaimer, the term of this patent is extended or adjusted under 35 U.S.C. 154(b) by 440 days.

(21) Appl. No.: 10/942,052

(22) Filed: Sep. 16, 2004

(65) Prior Publication Data

US 2005/0078107 A1 Apr. 14, 2005

(30) Foreign Application Priority Data

Sep. 18, 2003 (KR) ..... 10-2003-0064813

(51) Int. Cl.
*G09G 5/00* (2006.01)

(52) U.S. Cl. ..... 345/211; 345/60

(58) Field of Classification Search ..... 315/169.3, 315/276; 345/60, 211

See application file for complete search history.

(56) References Cited

U.S. PATENT DOCUMENTS

| | | | | |
|---|---|---|---|---|
| 6,011,355 | A | 1/2000 | Nagai | 315/167.3 |
| 6,628,275 | B2 * | 9/2003 | Vossen et al. | 345/211 |
| 6,657,604 | B2 * | 12/2003 | Huang et al. | 345/60 |
| 7,138,994 | B2 | 11/2006 | Cho et al. | 345/211 |
| 2002/0047577 | A1 * | 4/2002 | Roh et al. | 315/169.3 |
| 2003/0057854 | A1 * | 3/2003 | Roh | 315/169.3 |
| 2004/0036686 | A1 * | 2/2004 | Cho et al. | 345/211 |
| 2004/0075626 | A1 * | 4/2004 | Lee et al. | 345/60 |
| 2006/0043908 | A1 * | 3/2006 | Cho et al. | 315/276 |

FOREIGN PATENT DOCUMENTS

| | | |
|---|---|---|
| CN | 1417762 | 5/2003 |
| EP | 0 704 834 B1 | 1/2001 |
| KR | 10-2002-0061949 A | 7/2002 |

OTHER PUBLICATIONS

European Search Report dated Jan. 24, 2007.
Chinese Office Action dated Feb. 2, 2007.

* cited by examiner

*Primary Examiner*—Amare Mengistu
*Assistant Examiner*—Yuk Chow
(74) *Attorney, Agent, or Firm*—KED & Associates LLP

(57) ABSTRACT

Disclosed are an energy recovery apparatus and method for a plasma display panel. The energy recovery apparatus includes a sustain voltage source for supplying a sustain voltage, a panel capacitor formed equivalently at a discharge cell, a first charging circuit for forming a first charging path when one side of the panel capacitor is charged, a second charging circuit for forming a second charging path when the other side of the panel capacitor is charged, a first power circuit for supplying the sustain voltage to the panel capacitor and forming the first charging path, and a second power circuit for supplying a ground voltage generated from a ground voltage source to the panel capacitor and forming the second charging path. The energy recovery apparatus and method according to the present invention can decrease components in number and reduce power consumption and manufacturing cost by charging the other side of the panel capacitor using a charging voltage of one side of the panel capacitor.

25 Claims, 9 Drawing Sheets

ENERGY RECOVERY APPARATUS AND METHOD FOR PLASMA DISPLAY PANEL

This Nonprovisional application claims priority under 35 U.S.C. § 119(a) on Patent Application No. 10-2003-0064813 filed in Korea on Sep. 18, 2003, the entire contents of which are hereby incorporated by reference.

BACKGROUND OF THE INVENTION

1. Field of the Invention

The Present invention relates to a plasma display panel, and more particularly to an energy recovery apparatus and method for a plasma display panel.

2. Description of the Background Art

A plasma display panel (hereinafter, referred to as "PDP") displays a video image by adjusting a gas discharge period of each of pixels according. to digital video data. As a representative example, there is a PDP with three electrodes, driven by an alternating current (AC) voltage as shown in FIG. 1

Referring to FIG. 1, a discharge cell of a tri-electrode AC surface discharge PDP includes a scan electrode 28Y and a sustain electrode 29Z formed on an upper substrate 10, and an address electrode 20X formed on a lower substrate 18.

The scan electrode 28Y and the sustain electrode 29Z respectively include transparent electrodes 12Y and 12Z, and metal bus electrodes 13Y and 13Z that have a narrower width than the transparent electrodes 12Y and 12Z and that are formed at one end of each of the transparent electrodes 12Y and 12Z. The transparent electrodes 12Y and 12Z formed on the upper substrate 10 use Indium-Tin-Oxide (ITO). The metal bus electrodes 13Y and 13Z formed respectively on the transparent electrodes 12Y arid 12Z use metal such as chrome (Cr) and serve to reduce voltage drop caused by the transparent electrodes 12Y and 12Z with high resistance. An upper dielectric layer 14 and a protection film 16 are sequentially formed on the upper substrate 10 on which the scan electrode 28Y and the sustain electrode 29Z are formed. The upper dielectric layer 14 is accumulated with electric charges generated during the plasma discharge. The protection film 16 protects the upper dielectric layer 14 from sputtering generated during the plasma discharge and increases the emission efficiency of secondary electrons. Magnesium oxide (MgO) is usually used as the protection film 16.

The address electrode 20X is formed in such a manner that it intersects the scan electrode 28Y and the sustain electrode 29Z. A lower dielectric layer 22 and barrier ribs 24 are sequentially formed on the lower substrate 18 on which the address electrode 20X is formed. A phosphor layer 26 is coated on the lower dielectric layer 22 and the barrier ribs 24. The barrier ribs 24 are formed in parallel to the address electrode 20X to physically demarcate the discharge cell, and prevent ultraviolet rays and visual rays generated during the discharge from leaking toward neighboring discharge cells. The phosphor layer 26 is excited and emitted by ultraviolet generated during the plasma discharge and emits one of visual rays, i.e., red, green and blue. A mixed gas of inert gases, such as He+Xe, Ne+Xe or He+Xe+Ne, is injected into discharge spaces of the discharge cell formed between the upper and lower substrates 10 and 18 and the barrier ribs 24.

For the address discharge and sustain discharge of such an AC surface discharge PDP, there is needed a high voltage above a few hundreds volts. Therefore, in order to minimize a driving power necessary for the address discharge and sustain discharge, an energy recovery apparatus is used. The energy recovery apparatus recovers a voltage between the scan electrode and the sustain electrode and uses the recovered voltage as a driving voltage during the next discharge.

Referring to FIG. 2, there is shown a conventional energy recovery apparatus of a PDP. Energy recovery circuits 30 and 32 are symmetrically connected based on a panel capacitor Cp. The panel capacitor Cp is an equivalent expression of an electrostatic capacitance formed between a scan electrode Y and a sustain electrode Z. The first energy recovery circuit 30 supplies a sustain pulse to the scan electrode Y. The second energy recovery circuit 32 supplies a sustain pulse to the sustain electrode Z while alternatively operating to the first energy recovery circuit 30.

The operation of the conventional energy recovery apparatus of the PDP will now be described with reference to the first energy recovery circuit 30. The first energy recovery circuit 30 includes an inductor L connected between the panel capacitor Cp and a source capacitor Cs, first and third switches S1 and S3 connected in parallel between the source capacitor Cs and the inductor L, and second and fourth switches S2 and S4 connected in parallel between the panel capacitor Cp and the inductor L.

The second switch S2 is connected to a sustain voltage (Vs) source, and the fourth switch S4 is connected to a ground voltage (GND) source. The source capacitor Cs charges its voltage by recovering a voltage charged at the panel capacitor Cp during the sustain discharge and re-supplies the charged voltage to the panel capacitor Cp. A voltage of Vs/2 volts corresponding to half the sustain voltage Vs is charged at the source capacitor Cs. The inductor L and the panel capacitor Cp constitute a resonant circuit. The first to fourth switches S1 to S4 control the flow of current.

Meanwhile, fifth and sixth diodes D5 and D6 connected respectively between the switch S1 and the inductor L and between the third switch S3 and the inductor L serve to prevent reverse current.

FIG. 3 illustrates timing diagrams of the switches and a waveform diagram of the panel capacitor of the first energy recovery apparatus of FIG. 2.

It is assumed that before a period T1, a voltage of 0 volts is charged at the panel capacitor Cp and a voltage of Vs/2 volts is charged at source capacitor Cs.

During a period T1, the first switch S1 is turned ON and a current path is formed through the source capacitor Cs, the fist switch S1, tire inductor L and the panel capacitor Cp. If the current path is formed, a voltage charged at the source capacitor Cs is supplied to the panel capacitor Cp. In this case, since the inductor L and the panel capacitor Cp constitute a serial resonant circuit, a voltage of Vs is charged at the panel capacitor Cp.

During a period T2, the second switch S2 is turned ON. Then the sustain voltage Vs is supplied to the scan electrode Y. The sustain voltage Vs supplied to the scan electrode Y prevents the panel capacitor Cp from being lowered below the sustain voltage Vs, thereby normally generating a sustain discharge. On the other hand, since the voltage of the panel capacitor Cp is increased up to the sustain voltage Vs during the period T1, a driving voltage supplied from the exterior in order to create the sustain discharge is minimized.

During a period T3, the first switch S1 is turned OFF. During this period T3, the scan electrode Y maintains the sustain voltage Vs.

During a period T4, the second switch S2 is turned OFF and the third switch S3 is turned ON. If the third switch S3 is turned ON, a current path is formed through the panel capacitor Cp, the inductor L, the third switch S3 and the source capacitor Cs, and a voltage charged at the panel capacitor Cp is recovered to the source capacitor Cs. Then a voltage of Vs/2 is charged at the source capacitor Cs.

During a period T5, the third switch S3 is turned OFF and the fourth switch S4 is turned ON. If the fourth switch S4 is turned ON, a current path is formed through the panel capacitor Cp and the ground voltage GND, and a voltage of the panel capacitor Cp is lowered to 0 volts. During a period T6, the state of the period T5 is maintained for a predetermined time. An AC driving pulse supplied to the scan electrode Y and sustain electrode Z is obtained by periodically repeating the periods T1 to T6.

Meanwhile, the second energy recovery circuit 32 alternatively operates to the first energy recovery circuit 30 to supply a driving voltage to the panel capacitor Cp. Therefore, sustain pulse voltages Vs with opposite polarity are supplied to the panel capacitor Cp. Consequently, a sustain discharge occurs from the discharge cells by supplying the sustain pulse voltages Vs with opposite polarity to the panel capacitor Cp.

However, the conventional energy recovery apparatus needs lots of circuit components such as switching elements because the first energy recovery circuit 30 connected to the first electrode Y and the second energy recovery circuit 32 connected to the second electrode Z operate respectively. Therefore, manufacturing cost is increased. In addition, much power is consumed due to the switching loss of a plurality of switches, such as a diode, a switching element and an inductor, on the current path.

SUMMARY OF THE INVENTION

Accordingly, an object of the present invention is to solve at least the problems and disadvantages of the background art.

An object of the present invention is to provide an energy recovery apparatus and method for a plasma display panel which can decrease the number of components and reduce power consumption.

To accomplish the above objects, according to an aspect of the present invention, there is provided an energy recovery apparatus for a plasma display panel, including a sustain voltage source for supplying a sustain voltage, a panel capacitor formed equivalently at a discharge cell, a first charging circuit for forming a first charging path when one side of the panel capacitor is charged, a second charging circuit for forming a second charging path when the other side of the panel capacitor is charged, a first power circuit for supplying the sustain voltage to the panel capacitor and forming the first charging path, and a second power circuit for supplying a ground voltage generated from a ground voltage source to the panel capacitor and forming the second charging path.

According to another aspect of the present invention, there is also provided an energy recovery method for a plasma display panel, including the steps of supplying a charging voltage of the other side of a panel capacitor formed equivalently at a discharge cell to one side of the panel capacitor by using a fist charging path including a first inductor, and supplying a charging voltage of the one side of the panel capacitor to the other side of the panel capacitor by using a second charging path including a second inductor, wherein when voltages are supplied to the one and other sides of the panel capacitor, a voltage induced to the first inductor and a voltage induced to the second inductor is a reverse voltage.

The energy recovery apparatus and method according to the present invention can decrease components in number and reduce power consumption and manufacturing cost by charging the other side of the panel capacitor using a charging voltage of one side of the panel capacitor. In addition, the internal voltage of a circuit component can be lowered by using coupled inductors of which winding direction is set to apply a reverse voltage to each other.

BRIEF DESCRIPTION OF THE DRAWINGS

The invention will be described in detail with reference to tire following drawings in which like numerals refer to like elements.

DETAILED DESCRIPTION OF PREFERRED EMBODIMENTS

Figure 1:
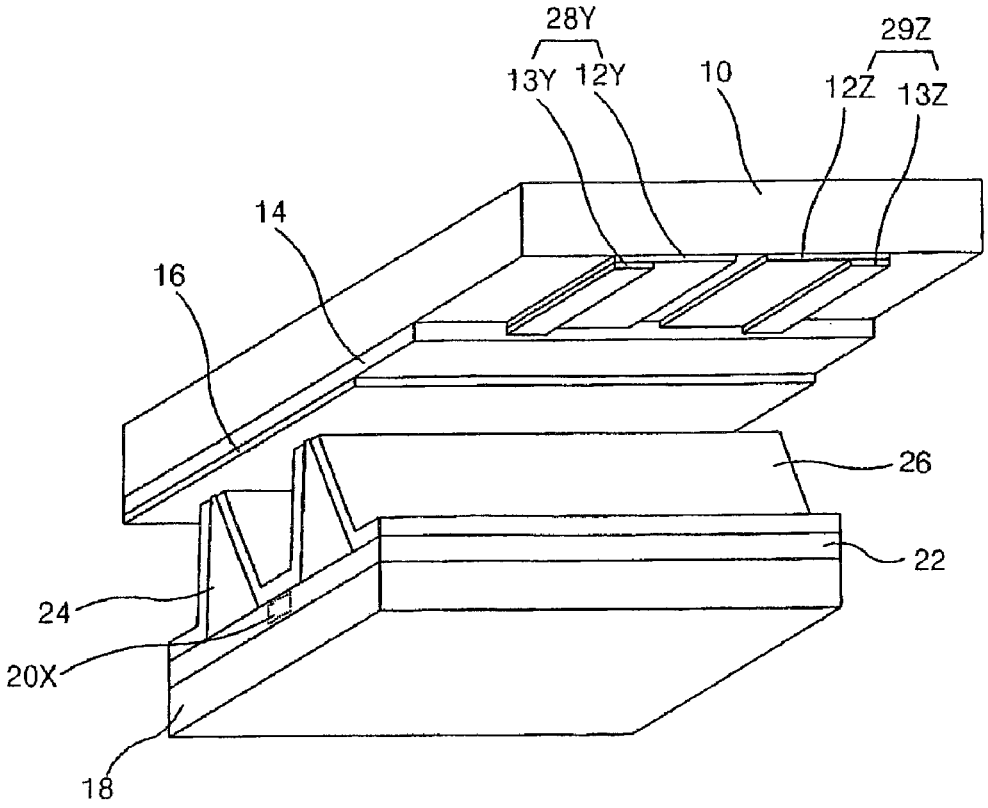
Fig. 1 PRIOR ART
FIG. 1 is a perspective view illustrating a discharge cell structure of a conventional tri-electrode AC surface discharge PDP.
Figure 2:
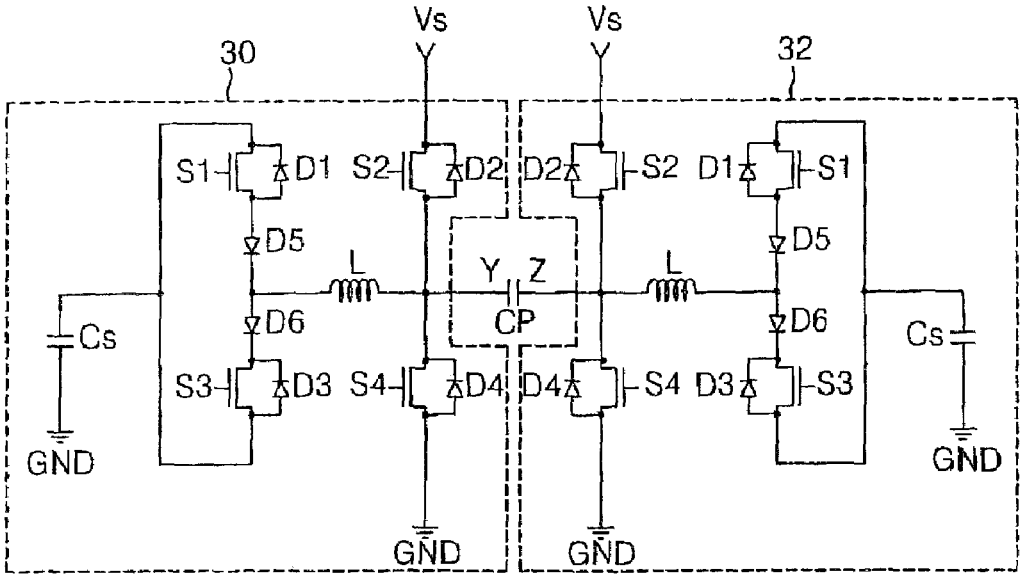
Fig. 2 PRIOR ART
FIG. 2 is a circuit diagram illustrating a conventional energy recovery apparatus.
Figure 3:
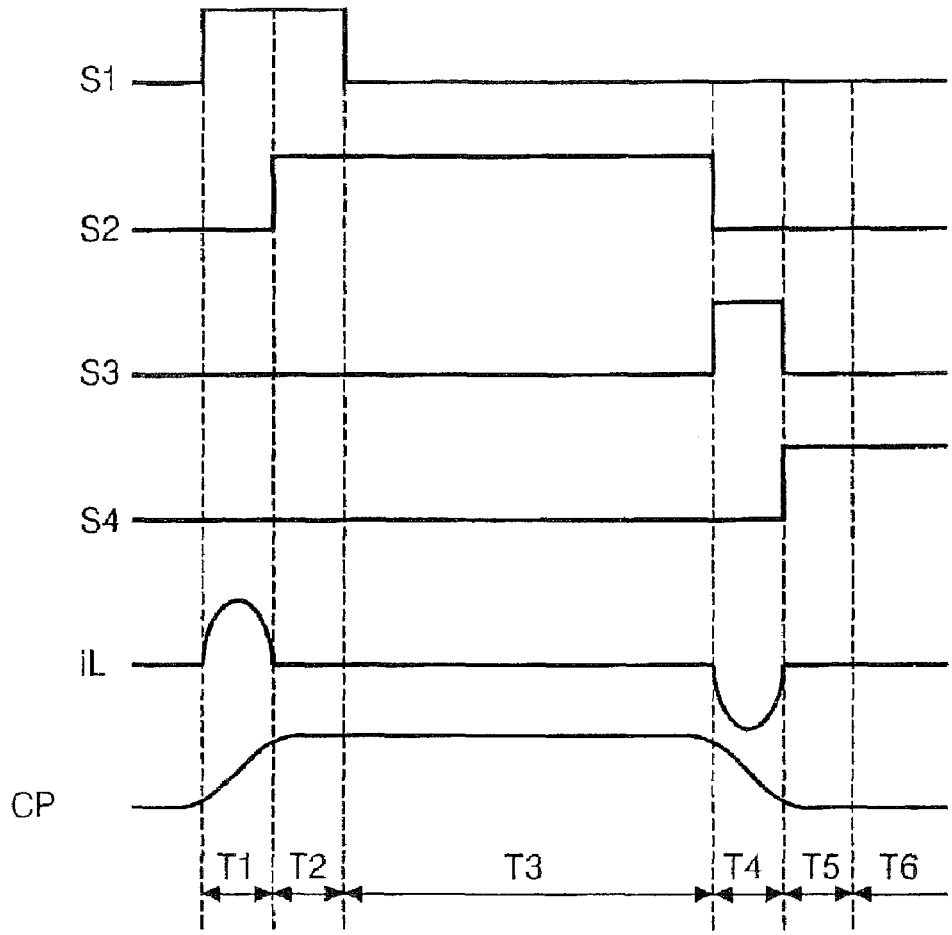
Fig. 3 PRIOR ART
FIG. 3 is a timing diagram illustrating an operation of switches shown in FIG. 2.

Preferred embodiments of the present invention will be described in a more detailed manner with reference to the drawings.

An energy recovery apparatus for a plasma display panel according to an embodiment of the present invention includes a sustain voltage source for supplying a sustain voltage, a panel capacitor formed equivalently at a discharge cell, a first charging circuit for forming a first charging path when one side of the panel capacitor is charged, a second charging circuit for forming a second charging path when the other side of the panel capacitor is charged, a first power circuit for supplying the sustain voltage to the panel capacitor and forming the first charging path, and a second power circuit for supplying a ground voltage generated from a ground voltage source to the panel capacitor and forming the second charging path.

Moreover, the first power circuit includes a first switch connected between the sustain voltage source and the one side of the panel capacitor, for forming the first charging path, and a second switch connected between the sustain voltage source and the other side of the panel capacitor.

The second power circuit includes a third switch connected between the ground voltage source and the one side of the panel capacitor, for forming the second charging path, and a fourth switch connected between the ground voltage source and the other side of the panel capacitor.

Moreover, the first charging circuit includes a first inductor connected between the other side of the panel capacitor and the first switch, for forming a resonant circuit together with the panel capacitor, and a first diode connected between the first inductor and the first switch, for preventing reverse current.

The second charging circuit includes a second inductor connected between the other side of the panel capacitor and the third switch, for forming a resonant circuit together with the panel capacitor, and a second diode connected between the second inductor and the third switch, for preventing reverse current.

The first power circuit further includes a diode connected between the second switch and the sustain voltage source, for preventing reverse current.

The second power circuit further includes a diode connected between the fourth switch and the other side of the panel capacitor, for preventing reverse current.

Preferably, the first and second inductors are coupled inductors.

Preferably, the first and second inductors are set their winding direction to induce a reverse voltage to each other.

The winding direction of the first and second inductors is set to maintain a voltage between the first and second diodes at approximately 0 volts during the charging and discharging operation of the panel capacitor.

According to another embodiment of the present invention, in an energy recovery apparatus for a plasma display panel, including a sustain voltage source for supplying a sustain voltage, a panel capacitor formed equivalently at a discharge cell, a first charging circuit for forming a first charging path when one side of the panel capacitor is charged, a second charging circuit for forming a second charging path when the other side of the panel capacitor is charged, a first power circuit for supplying the sustain voltage to the panel capacitor and forming the first charging path, and a second power circuit for supplying a ground voltage to the panel capacitor and forming the second charging path, the first charging circuit includes a first inductor connected between the other side of the panel capacitor and the first switch, for forming a resonant circuit together with the panel capacitor, and a first diode connected between the first inductor and the first switch, for preventing reverse current. The second charging circuit includes a second inductor connected between the other side of the panel capacitor and the third switch, for forming a resonant circuit together with the panel capacitor, and a second diode connected between the second inductor and the third switch, for preventing reverse current. The first and second inductors are coupled inductors.

An energy recovery method for a plasma display panel according to an embodiment of the present invention includes the steps of supplying a charging voltage of the other side of a panel capacitor formed equivalently at a discharge cell to one side of the panel capacitor by using a fist charging path including a first inductor, and supplying a charging voltage of the one side of the panel capacitor to the other side of the panel capacitor by using a second charging path including a second inductor, wherein when voltages are supplied to the one and other sides of the panel capacitor, a voltage induced to the first inductor and a voltage induced to the second inductor is a reverse voltage.

Moreover, the first and second inductors are set their winding direction to induce a reverse voltage to each other.

Moreover, the energy recovery method further includes the steps of maintaining a charging voltage after the one side of the panel capacitor is charged through the first charge path, and maintaining a charging voltage after the other side of the panel capacitor is charged through the second charging path.

Figure 4:
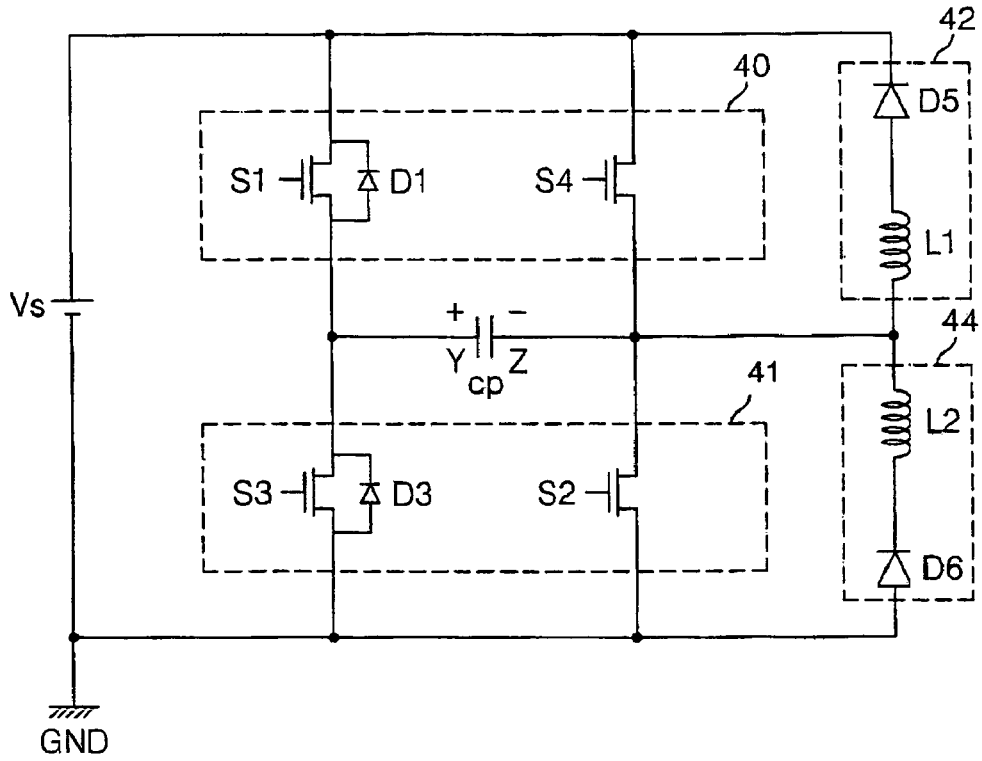
FIG. 4 is a circuit diagram illustrating an energy recovery apparatus according to a preferred embodiment of the present invention.

FIG. 4 is a circuit diagram illustrating an energy recovery apparatus according to a preferred embodiment of the present invention.

Referring to FIG. 4, the energy recovery apparatus includes a panel capacitor Cp equivalently denoting electrostatic capacitance formed between a scan electrode Y and a sustain electrode Z, first and second power circuits 40 and 41 connected to the panel capacitor Cp, a first charging circuit 42 for providing a charging path of a first electrode (for example, a scan electrode Y) of the panel capacitor Cp, and a second charging circuit 44 for providing a charging path of a second electrode (for example, a sustain electrode Z) of the panel capacitor Cp.

The first power circuit 40 supplies a sustain voltage Vs to the panel capacitor Cp. For this, the first power circuit 40 includes a first switch S1 and a fourth switch S4 connected to the sustain voltage Vs.

The second power voltage 41 supplies a ground voltage GND to the panel capacitor Cp. For this, the second power voltage 41 includes a third switch S3 and a second switch S2 connected to the ground voltage GND.

The first switch S1 is turned ON when the sustain voltage Vs is supplied to the first electrode of the panel capacitor Cp. Moreover, the first switch S1 provides a charging path of the first electrode of the panel capacitor Cp, together with the first charging circuit 42. The detailed description thereof will be explained later on. The fourth switch S4 is turned ON when the sustain voltage Vs is supplied to the second electrode of the panel capacitor Cp.

The third switch S3 is turned ON when the ground voltage GND is supplied to the first electrode of the panel capacitor Cp. The third switch S3 and the second charging circuit 44 provide a charging path of the second electrode of the panel capacitor Cp. The second switch S2 is turned ON when the ground voltage GND is supplied to the second electrode of the panel capacitor Cp. Internal diodes D1 and D3 for controlling the flow of current are respectively installed at the interior of the first and second switches S1 and S3.

The first charging circuit 42 provides a charging path together with the first switch S1 when the first electrode of the panel capacitor Cp is charged and constitutes a resonant circuit together with the panel capacitor Cp. The first charging circuit 42 includes a first inductor L1 connected between the first switch S1 and the second electrode of the panel capacitor Cp, and a fifth diode D5 connected between the first inductor L1 and the first switch S1. The first inductor L1 and the panel capacitor Cp form a resonant circuit when the first electrode of the panel capacitor Cp is charged. The fifth diode D5 serves to prevent reverse current.

The second charging circuit 44 provides a charging path together with the third switch S3 when the second electrode of the panel capacitor Cp is charged and constitutes a resonant circuit together with the panel capacitor Cp. The second charging circuit 44 includes a second inductor L2 connected between the third switch S3 and the second electrode of the panel capacitor Cp, and a sixth diode D6 connected between the second inductor L2 and the third switch S3. The second inductor L2 forms a resonant circuit together with the panel capacitor Cp when the second electrode of the panel capacitor Cp is charged. The sixth diode D6 serves to prevent reverse current.

Figure 5:
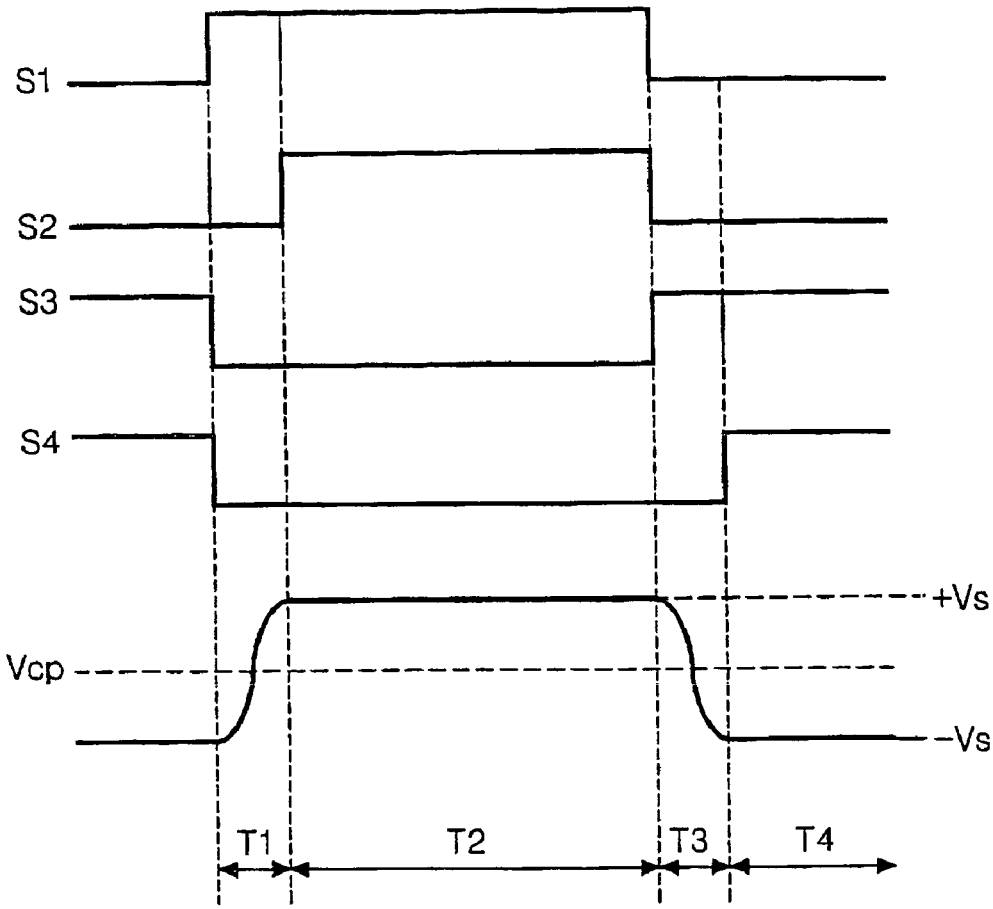
FIG. 5 is a timing diagram illustrating an operation of switches shown in FIG. 4.

FIG. 5 shows timing diagrams of the switches and a waveform diagram of a voltage supplied to the panel capacitor shown in the energy recovery apparatus of FIG. 4. It is set that the first electrode Y of the panel capacitor Cp is positive polarity and the second electrode Z of the panel capacitor Cp is negative polarity.

An operation of the energy recovery apparatus will now be described under the assumption that a voltage of +Vs has been charged at the Z side of the panel capacitor Cp before a period T1. During a period T1, the first switch S1 is turned ON. Then a current path is formed through the Z side of the panel capacitor Cp, the first inductor L1, the fifth diode D5, the first switch S1 and the Y side of the panel capacitor Cp. That is, if the first switch S1 is turned ON, a voltage of the Z side of the panel capacitor Co is supplied to the Y side of the panel capacitor Cp. In this case, the first inductor L1 and the panel capacitor Cp form a resonant circuit, a voltage of the Y side of the panel capacitor Cp is raised up to +Vs.

During a period T2, the second switch S2 is turned ON. Then a current path is formed through the sustain voltage Vs, the first switch S1, the Y and Z sides of the panel capacitor Cp, the second switch S2 and the ground voltage GND. In this case, the sustain voltage Vs is supplied to the Y side of the panel capacitor Cp. That is, during the period T2, a stable sustain discharge occurs while the Y side of the panel capacitor Cp maintains the sustain voltage Vs.

During a period T3, the first, and second switches S1, S2 are turned off and S3 is turned ON. Then a current path is formed through the Y side of the panel capacitor. Cp, the third switch S3, the sixth diode D6, the second inductor L2 and the Z side of the panel capacitor Cp. That is, if the third switch S3 is turned ON, a voltage of the Y side of the panel capacitor Cp is supplied to the Z side of the panel capacitor Cp. In this case, since the second inductor L2 and the panel capacitor Cp form a resonant circuit, a voltage of the Z side of the panel capacitor Cp is raised up to +Vs.

During a period T4, the fourth switch S4 is turned ON. Then a current path is formed through the sustain voltage Vs, the fourth switch S4, the Z and Y sides of the panel capacitor Cp, the third switch S3 and the ground voltage GND. In this case, the sustain voltage Vs is supplied to the Z side of the panel capacitor. That is, during this period T4, a stable sustain discharge occurs while the z side of the panel capacitor Cp maintains the sustain voltage Vs.

Figure 6:
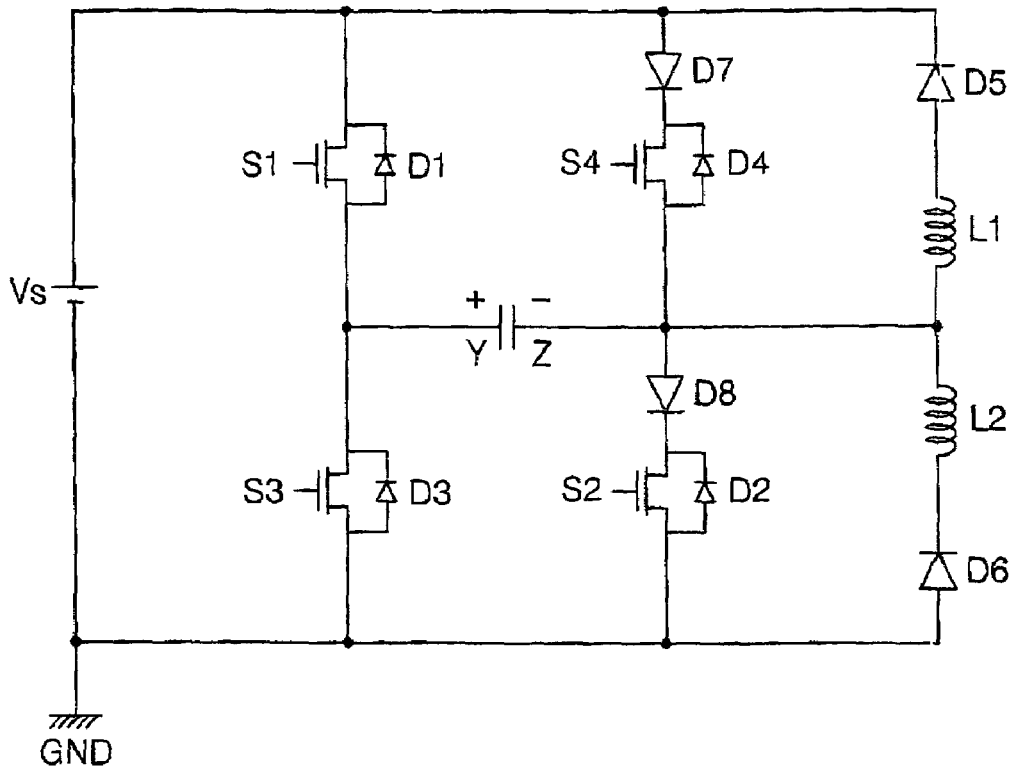
FIG. 6 is a circuit diagram illustrating diodes connected additionally to the energy recovery device of FIG. 4.

Meanwhile, as shown in FIG. 6, the energy recovery apparatus according to the present invention may further include a seventh diode D7 connected between the fourth switch S4 and the fifth diode D5, an eighth diode D8 connected between the second switch S2 and the Z side of the panel capacitor Cp, and internal diodes D2 and D4 installed respectively at the interior of the second and fourth switches S2 and S4. The seventh diode D7, the eighth diode D8 and the internal diodes D2 and D4 serve to prevent reverse current and to operate the energy recovery apparatus stably.

The above-described energy recovery apparatus can decrease components in number in comparison with the conventional apparatus, by charging the other side of the panel capacitor Cp using a charging voltage of one side of the panel capacitor Cp. Therefore, power consumption and manufacturing cost can be reduced.

Meanwhile, the energy recovery apparatus shown in FIG. 4 includes the diodes D5 and D6 with high internal voltage. When a voltage of the first electrode (or the second electrode) of the panel capacitor Cp is supplied to the second electrode (or the first electrode) of the panel capacitor, since it passes through the resonant circuit, a voltage of Vs (or Vs) is lowered (or raised) to Vs (or Vs). Therefore, during the charging and discharging of the panel capacitor Cp, a voltage across both ends of each of the fifth and sixth diodes D5 and D6 is set to a maximum of 2Vs. In other words, in the energy recovery apparatus shown in FIG. 4, the fifth and sixth diodes D5 and D6 should be set to endure a high voltage above 2Vs. Consequently, the manufacturing cost is increased.

Figure 7:
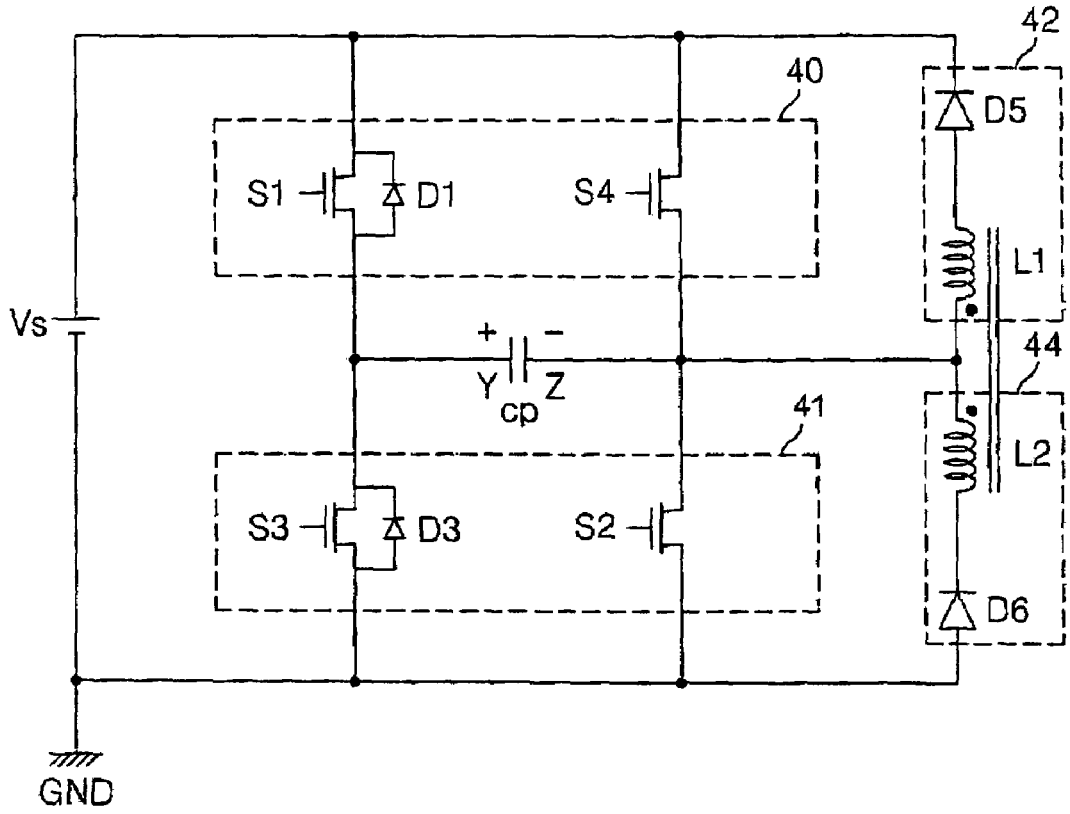
FIG. 7 is a circuit diagram illustrating an energy recovery apparatus according to another preferred embodiment of the present invention.

In order to overcome such a disadvantage, another energy recovery apparatus is proposed as shown in FIG. 7.

The energy recovery apparatus of FIG: 7 is identically driven to that of FIG. 4. However, the first and second inductors L1 and L2 are coupled inductors.

Referring to FIG. 7, the energy recovery apparatus includes a panel capacitor Cp equivalently denoting an electrostatic capacitance formed between a scan electrode Y and a sustain electrode Z, a power supply circuit 40 connected to the panel capacitor Cp, a first charging circuit 42 for providing a charging path of a first electrode (for example, the scan electrode Y) of the panel capacitor Cp, and a second charging circuit 44 for providing a charging path of a second electrode (for example, the sustain electrode Z) of the panel capacitor Cp. The operation of the energy recovery apparatus of FIG. 7 is the same as that of FIG. 4, and thus the detail description thereof will be omitted.

Figure 8:
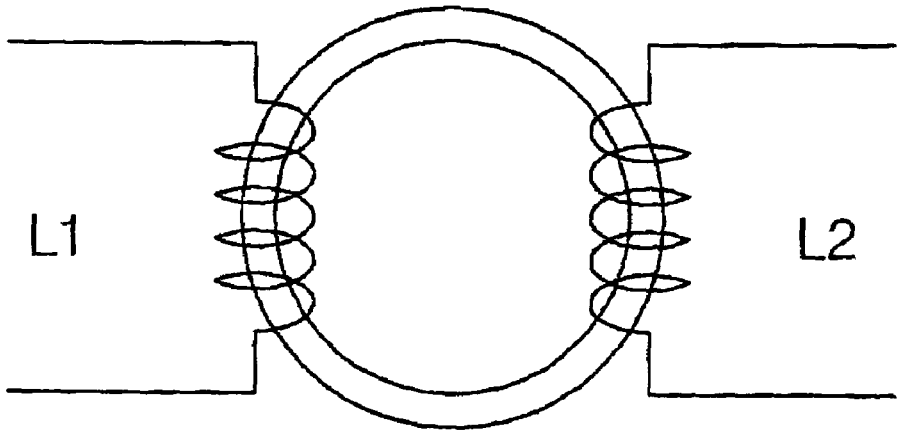
FIG. 8 is a diagram illustrating first and second inductors shown in FIG. 7.
Figure 9:
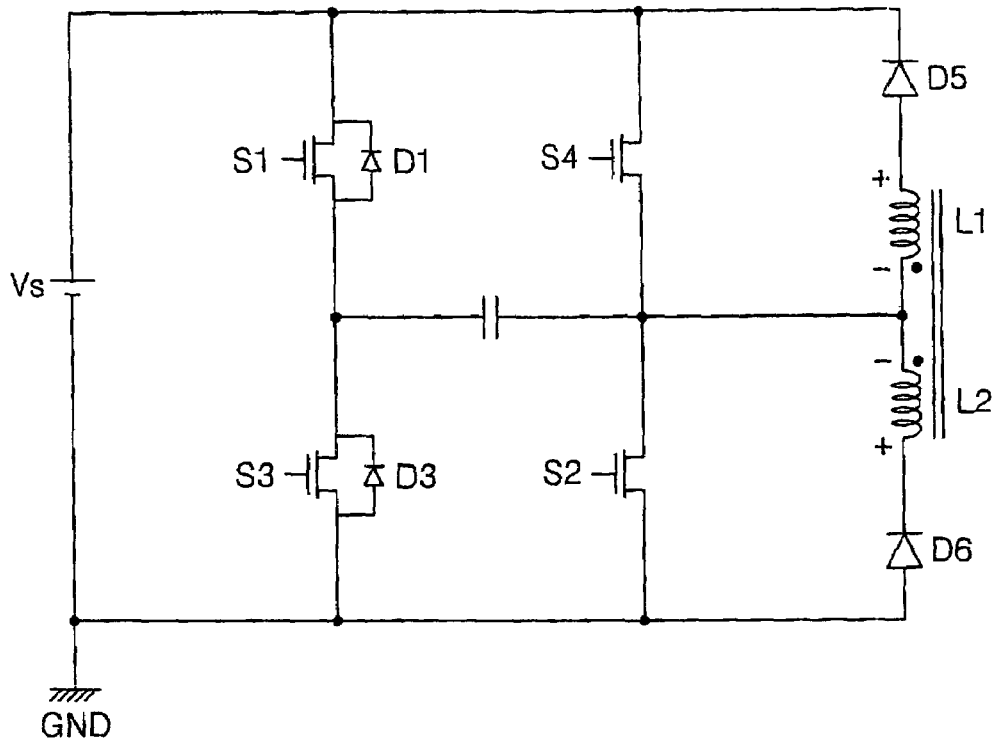
FIG. 9 is a diagram illustrating an example of voltages induced to the first and second inductors shown in FIG. 7.
Figure 10:
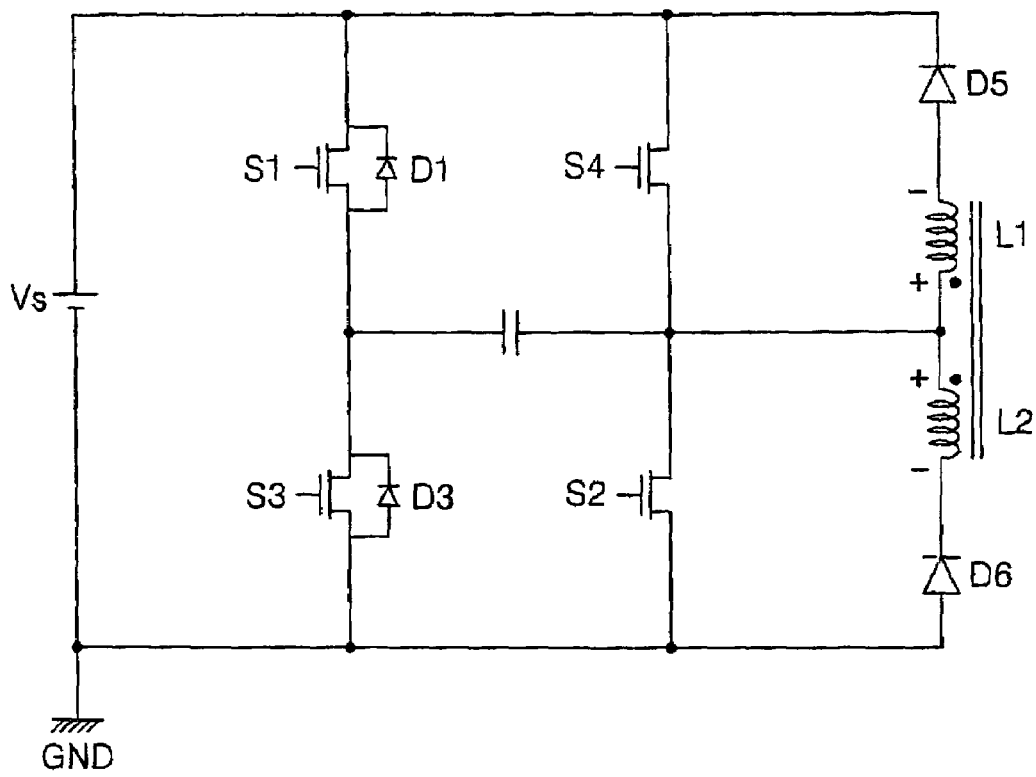
FIG. 10 is a diagram illustrating another example of voltages induced to the first and second inductors shown in FIG. 7.

However, the first and second inductors L1 and L2 are coupled inductors as shown in FIG. 8. By current flowing into the first inductor L1 (or the second inductor L2), the identical current (or voltage) is induced to the second inductor L2 (or the first inductor L1).

A winding direction of the coupled inductor is set to induce a reverse voltage to the first and second inductors L1 and L2 during the charging and discharging operation of the panel capacitor Cp. That is, the winding direction of the first and second inductors L1 and L2 is set to have a voltage of 0 volts between the fifth and sixth diodes D5 and D6 during the charging and discharging operation of the panel capacitor Cp. Since the reverse voltage is induced to the first and second inductors L1 and L2 during the charging and discharging operation of the panel capacitor Cp, the total voltage between the fifth and sixth diodes is set to approximately 0 volts.

If a voltage between the fifth and sixth diodes D5 and D6 is set to approximately 0 volts during the charging and discharging operation of the panel capacitor Cp, the internal voltage of each of the fifth and sixth diodes D5 and D6 can be set to approximately Vs volts. That is, the maximum voltage applied to both ends of each of the fifth and sixth diodes D5 and D6 during the charging and discharging operation of the panel capacitor is set to Vs or less. Therefore the manufacturing cost can be decreased.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An energy recovery apparatus for a plasma display panel having a plurality of first and second electrodes and a panel capacitance, comprising:

a voltage source configured to supply a sustain voltage;

a first charging circuit configured to form a first charging path between first and second nodes of the panel capacitance, the first charging circuit having a first inductor;

a second charging circuit configured to form a second charging path between first and second nodes of the panel capacitance, the second charging circuit having a second inductor;

a first power circuit configured to form the first charging path with the first charging circuit from the second node to the first node of the panel capacitance such that a potential of the first node is substantially raised to the sustain voltage;

a second power circuit configured to form the second charging path with the second charging circuit from the first node to the second node of the panel capacitance such that a potential of the second node is substantially raised to the sustain voltage, the first power circuit is further configured to clamp one of the first or second nodes to the sustain voltage when the potential of one of the first and second nodes substantially reaches the sustain voltage, and the second power circuit is configure to clamp one of (1) the first node to a prescribed voltage when the second node is clamped to the sustain voltage or (2) the second node to the prescribed voltage when the first node is clamped to the sustain voltage, wherein the first charging circuit is coupled in parallel across nodes of the first power circuit and wherein the second charging circuit is coupled in parallel across nodes of the second power circuit.

2. The energy recovery apparatus according to claim 1, wherein the first power circuit includes:

a first switch coupled between the voltage source and the first node of the panel capacitance; and a second switch coupled between the sustain voltage source and the second node of the panel capacitance, wherein the first switch has a third node and the second switch has a fourth node and wherein the first charging circuit is coupled in parallel across at least the second node of the panel capacitance and the fourth node of the second switch, the third node of the first switch and the fourth node of the second switch coupled to the voltage source.

3. The energy recovery apparatus according to claim 2, wherein the second power circuit includes:

a third switch coupled between a prescribed voltage source and the first node of the panel capacitance; and a fourth switch coupled between the prescribed voltage source and the second node of the panel capacitance, wherein the third switch as a fifth node and the fourth switch has a sixth node and wherein the second charging circuit is coupled in parallel across at least the second node of the panel capacitance and the sixth node of the fourth switch, the fifth node of the third switch and the sixth node of the fourth switch coupled to the prescribed voltage.

4. The energy recovery apparatus according to claim 2, wherein the first charging circuit includes:

a first diode coupled to the first switch and the second switch; and wherein the first inductor is coupled between the second node of the panel capacitance and the first diode.

5. The energy recovery apparatus according to claim 2, wherein the first power circuit further includes a diode coupled in parallel with the first switch.

6. The energy recovery apparatus according to claim 2, further comprising:

a diode coupled between the first power circuit and the voltage source; and another diode coupled between one of the first and second nodes of the panel capacitance and the second power circuit.

7. The energy recovery apparatus according to claim 3, wherein the second charging circuit includes:

a second diode coupled to the third switch and the fourth switch; and wherein the second inductor coupled is between the second node of the panel capacitance and the second diode.

8. The energy recovery apparatus according to claim 3, wherein the second power circuit further includes a diode coupled in parallel with the third switch.

9. The energy recovery apparatus according to claim 3, wherein the first charging circuit includes:

a first diode coupled to the first switch and the second switch; and the first inductor coupled between the second node of the panel capacitance and the first diode, and wherein the second charging circuit includes:

a second diode coupled to the third switch and the fourth switch; and the second inductor coupled between the second node of the panel capacitance and the second diode.

10. The energy recovery apparatus according to claim 9, wherein the first and second inductors are coupled inductors.

11. The energy recovery apparatus according to claim 9, wherein winding directions of the first and second inductors are set so that a voltage of substantially zero volts is formed between the first and second diodes during charging and discharging operations of the panel capacitance.

12. The energy recovery apparatus according to claim 10, wherein a winding direction of the first and second inductors is set to induce a reverse voltage to each other.

13. The energy recovery apparatus according to claim 10, wherein a winding direction of the first and second inductors is set to maintain a voltage between the first and second diodes at approximately 0 volt during the charging and discharging operation of the panel capacitance.

14. The energy recovery apparatus of claim 1, wherein the prescribed voltage is a ground voltage.

15. The energy recovery apparatus of claim 1, wherein the first and second charging paths are different conductive paths.

16. The energy recovery apparatus of claim 1, wherein conductive directions of the first and second charging paths have opposite directions.

17. The energy recovery apparatus of claim 1, wherein the first and second nodes are commonly coupled to the second node of the panel capacitance.

18. The energy recovery apparatus according to claim 1, wherein the first and second inductors are coupled to form a transformer.

19. An energy recovery method for a plasma display panel having a plurality of first and second electrodes and a panel capacitance, comprising:

providing a first charging path between a first node of the panel capacitance to a second node of the panel capacitance using a first inductor, a potential of the first node being raised from a first voltage to a second voltage;

clamping the first node to the second voltage and the second node to the first voltage;

providing a second charging path between the first node of the panel capacitance to the second node of the panel capacitance using a second inductor, a potential of the second node being raised from the first voltage to the second voltage; and clamping the first node to the first voltage and the second node to the second voltage, wherein the first inductor is coupled in parallel across the first and second nodes of the panel capacitance and wherein the second inductor is coupled in parallel across the first and second nodes of the panel capacitance.

20. The energy recovery method of claim 19, wherein the second voltage is a sustain voltage, and the first voltage is a ground voltage.

21. The energy recovery method of claim 19 wherein the first inductor and the second inductor are coupled to a common node.

22. The energy recovery method of claim 19, wherein a winding direction of the first and second inductors is set to induce a reverse voltage to each other.

23. The energy recovery method of claim 19, wherein a winding direction of the first and second inductors is set to maintain a voltage between the first and second diodes at approximately 0 volt during the charging and discharging operation of the panel capacitance.

24. The energy recovery method of claim 19, wherein the first and second charging paths are different conductive paths.

25. The energy recovery apparatus of claim 19, wherein conductive directions of the first and second charging paths have opposite directions.

* * * * *